US006431355B1

(12) United States Patent
Miura et al.

(10) Patent No.: US 6,431,355 B1
(45) **Date of Patent: *Aug. 13, 2002**

(54) CORE MATERIAL FOR CADDIE BAG AND CADDIE BAG USING THE CORE MATERIAL

(75) Inventors: Koryo Miura, Machida; Satoshi Yoshida; Mototaka Iwata, both of Osaka, all of (JP)

(73) Assignee: Mizuno Corporation, Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/380,769

(22) PCT Filed: Jan. 27, 1999

(86) PCT No.: PCT/JP99/00329

§ 371 (c)(1),
(2), (4) Date: Sep. 13, 1999

(87) PCT Pub. No.: WO99/38577

PCT Pub. Date: Aug. 5, 1999

(30) Foreign Application Priority Data

Feb. 2, 1998 (JP) ..... 10-36648

(51) Int. Cl.[7] ..... A63B 55/00

(52) U.S. Cl. ..... 206/315.8; 206/315.3; 264/295; 264/553; 29/416

(58) Field of Search ..... 206/315.3, 315.6, 206/315.8; 220/669, 666, 675, 6, 907; 215/900; 264/295, 320, 222, 553; 29/412, 416

(56) References Cited

U.S. PATENT DOCUMENTS

| | | | |
|---|---|---|---|
| 5,314,063 | A | 5/1994 | Lee et al. |
| 5,711,244 | A | 1/1998 | Knapp |

FOREIGN PATENT DOCUMENTS

| | | |
|---|---|---|
| JP | 52-48540 | 12/1977 |
| JP | 54-100127 | 8/1979 |
| JP | 62-3171 | 1/1987 |

OTHER PUBLICATIONS

"Proposition of Pseudo–Cylindrical Polyhedral Shells", K. Miura, Institute of Space and Aeronautical Science, University of Tokyo, Report No. 422, vol. 34, No. 9, 1969, pp. 141–163.

*Primary Examiner*—Lee Young
*Assistant Examiner*—Tri M Mai
(74) *Attorney, Agent, or Firm*—McDermott, Will & Emery

(57) ABSTRACT

A core (3) for a caddie bag includes three arc portions (31 to 33) each with a PCCP structure. These arc portions are connected by a hinge portion (34) without the PCCP structure, and the hinge portion is bent to form a cylindrical core. The cylindrical core has one end with a collar (5) attached thereto, and the other end with a bottom member (6) attached thereto. The collar and the bottom member are connected by a frame member (12), whereby a caddie bag (1) is constructed.

8 Claims, 9 Drawing Sheets

CORE MATERIAL FOR CADDIE BAG AND CADDIE BAG USING THE CORE MATERIAL

TECHNICAL FIELD

The present invention relates to a core for a caddie bag and a caddie bag using the core. More particularly, the present invention relates to a core structure for a caddie bag that is improved in rigidity while preventing or limiting to the utmost, an increase in the weight, and to a caddie bag using that core structure.

BACKGROUND ART

According to the recent spread-out view in door-to-door delivery services, caddie bags have often been delivered to and from golf courses using the delivery systems. When players drive to the golf course, a plurality of caddie bags are loaded up in the trunk. Under these circumstances, caddie bags may be roughly handled by the delivery service, or left inside the trunk in which the temperature may exceed 60° C. in summer and go under −10° C. in winter, which will result in deformation and breaks of the caddie bags during transportation.

From the standpoint of preventing such deformation, a soft material that may suffer deformation can be used as a core structure of the caddie bag as long as the deformation can be restored. On the other hand, any rigid material will be unsuitable for the core structure if it does not recover once it is deformed. In view of protection of golf clubs, a core structure that permits no deformation is ideal. To satisfy these conditions, empirically 0.9 thick polypropylene has conventionally been used, as it is light in weight and exhibits good recovery from deformation.

When caddie bags suffer more deformation and breaks as described above, however, it is necessary to increase the rigidity of the core structure of the caddie bags. Ways to improve the rigidity of the caddie bags include: to use a thick core structure; to add reinforcements to the core structure; and to use a material of high modulus of elasticity as a raw material of the core.

More specifically, for a normal caddie bag having a diameter of 8.5 inches (i.e., a bottom diameter of 210 mm), a core structure with a size of 720 mm (height)×690 mm (circumference)×0.9 mm (thickness) is needed, including a 30 mm seam allowance for overlapping portions.

When it is made of a sheet of polypropylene, the core structure weighs 407 g. When this core structure is actually sewn into a cylindrical form, and if it is compressed toward the central axis of the cylinder, a load by the compression when it is displaced by 20 mm is 0.66 kgf. It can be said that this compressive load value should be as large as possible to address the above problem of the caddie bag.

A caddie bag largely consists of a core structure, a surface material, and accessories including a belt. A normal caddie bag of a diameter of 8.5 inches (i.e., a bottom diameter of 210 mm) with the surface material and the accessories weighs approximately 3.0 kg, in which the weight of the core structure accounts for 13% of the total weight of the caddie bag. A so-called lightweight caddie bag weighs about 2.0 kg including its surface material and the accessories, where the core structure comprises 20% of the total weight.

If a thick core structure is used or reinforcements are added to the core as described above in order to improve the rigidity of the caddie bag, the weight of the core naturally increases, which will result in increased weight of the entire caddie bag.

If a material of high modulus of elasticity is used as a raw material of the core, it will be difficult to roll the material as well as to machine-stitch it into a cylindrical form, thus degrading its workability. Furthermore, such material of high modulus of elasticity will increase unit price.

Accordingly, a main object of the present invention is to provide a caddie bag free from deformation and breaks, by considering a core structure that is improved in rigidity without increasing its weight and by considering the structure of the core.

Disclosure of the Invention

One aspect of the present invention is directed to a core structure for a caddie bag, which includes a PCCP (Pseudo-Cylindrical Concave Polyhedral) structure. The core structure according to embodiments of the present invention can be constructed entirely or partially of the PCCP structure, with a smooth second material without the PCCP structure superposed on either one or both of the outer surface and the inner surface of the core structure.

Another aspect of the present invention is directed to a core structure of a caddie bag, which includes a plurality of arc portions having the PCCP structure, and a hinge portion without the PCCP structure for connecting the plurality of arc portions together. The hinge portion is bent to shape the core structure into a cylindrical form. A smooth, second core structure without the PCCP structure can be superposed on either one or both of the outer and the inner surfaces of the core structure.

Yet another aspect of the present invention is directed to a caddie bag that has a core structure configured to have the PCCP structure. According to a more preferred embodiment, the caddie bag is formed into a cylindrical form, with one end having an opening provided with a collar, and the other end closed by a bottom member, and the collar and the bottom member are connected to each other by a frame member.

The core structure of the caddie bag is fabricated entirely or partially of the PCCP structure. The core structure includes a plurality of arc portions having the PCCP structure, and a hinge portion without the PCCP structure that connects the plurality of arc portions together. The hinge portion is bent to shape the core into a cylindrical form. The frame member is detachable, and made, for example, of a pipe frame, with a portion formed into a handle.

towards the central axis of the cylinder, while minimally increasing the weight of the bag.

Although the vertexes of ridges and valleys have obtuse angles in FIGS. 12A to 12D, these portions may be configured as convex and concave arcs.

Furthermore, since the rigidity of the core structure towards the center of the cylinder is improved compared with a conventional core having the same thickness, if the same rigidity as the conventional one is desired, the core structure can be made thinner, and hence, made lighter in weight. These facts are listed in Table 1.

TABLE 1

| Unit | Polypropylene Sheet Thickness mm | Polypropylene Sheet Gravity | Bottom Diameter mm | Total Height mm | Base Of Triangle mm | Height Of Triangle mm | Length of Core When Developed mm | Width of Core When Developed + Seam Allowance mm | Weight g | Compressive Load toward Central Axis of the Cylinder (When Displaced by 20 mm) kgf | Compressive Strength per Unit Weight $\times 10^{-5}$ kgf/(mm · g) |
|---|---|---|---|---|---|---|---|---|---|---|---|
| PCCP1 | 0.9 | 0.91 | 210 | 720 | 64.9 | 30.4 | 730 | 679 | 406 | 3.08 | 37.5 |
| PCCP2 | 0.9 | 0.91 | 210 | 720 | 80.4 | 31.0 | 745 | 673 | 411 | 5.75 | 70.8 |
| Cylindrical Core "a" | 0.9 | 0.91 | 210 | 720 | — | — | 720 | 690 | 407 | 0.66 | 8.1 |
| Cylindrical Core "b" | 1.5 | 0.91 | 210 | 720 | — | — | 720 | 690 | 678 | — | — |
| Cylindrical Core "c" | 1.85 | 0.91 | 210 | 720 | — | — | 720 | 690 | 836 | — | — |

BEST MODES FOR CARRYING OUT THE INVENTION

In the present invention, a PCCP structure has been used as a core of a caddie bag. Here, PCCP is an abbreviation of "Pseudo-Cylindrical Concave Polyhedral" structure. The PCCP structure is described in detail in "INSTITUTE OF SPACE AND AERONAUTICAL SCIENCE UNIVERSITY OF TOKYO" REPORT No. 442 (1969).

Figure 11:
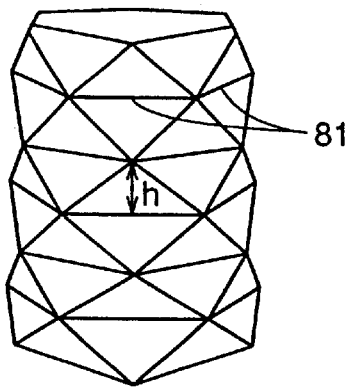
FIG. 11 is a perspective view of a cylindrical form having the PCCP structure.

FIG. 11 is a diagram of a cylindrical form having the PCCP structure, and FIGS. 12A to 12D are spread-out views of the cylindrical form having the PCCP structure.

Figure 12A:
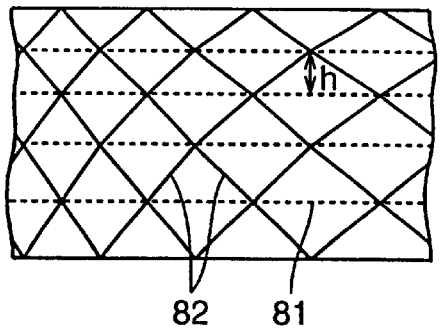
FIGS. 12A to 12D are spread-out views of the cylindrical form having the PCCP structure as shown in FIG. 11.

As shown in FIG. 11, the PCCP structure is generally cylindrical in a macroscopic sense, but it is actually formed of pairs of triangles arranged into diamond patterns, or pairs of trapezoids arranged into hexagonal patterns (not shown). In FIGS. 12A to 12D, solid lines except for the outlines represent "ridges," whereas dotted lines represent "valleys." In the PCCP structure consisting of triangles arranged into diamond patterns, the cylindrical form is constructed with bases 81 of the triangles as the valleys and hypotenuses 82 thereof as the ridges, as shown in FIG. 12A or 12C.

Figure 12B:
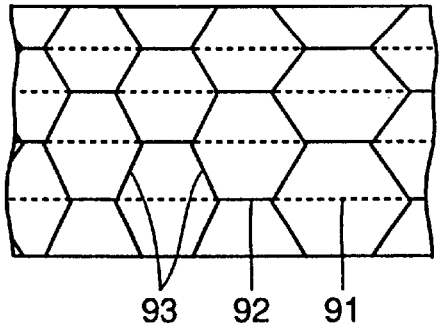
Figure 12C:
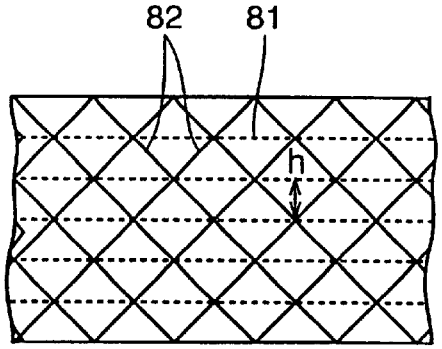
Figure 12D:
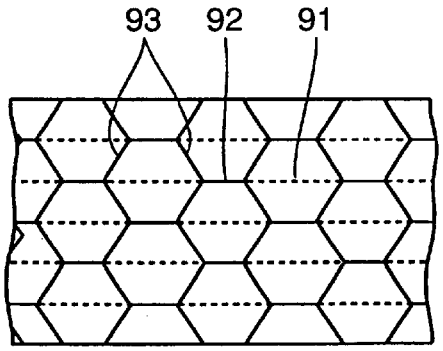

In the PCCP structure with trapezoids arranged into hexagonal patterns, the lower bases 91 of the trapezoids serve as the valleys and the upper bases 92 and hypotenuses 93 serve as the ridges to constitute the cylindrical form, as shown in FIG. 12B or 12D. A cylindrical form having such a PCCP structure characteristically increases its rigidity towards the central axis of the cylinder, compared with that of a cylindrical form made of a smooth core structure of the same thickness. Therefore, the PCCP structure is uniquely suited for construction of the caddie bag core shaped into the cylindrical form. This core having the PCCP structure makes it possible to design the caddie bag to have improved rigidity Table 1 compares conventional cylindrical cores having smooth surfaces with those having the PCCP structure. All the cores are of 210 mm in diameter, 720 mm in height and 0.9 mm in thickness, and each formed of a polypropylene sheet.

The cylindrical core PCCP1 having the PCCP structure used in the experiment has a form as shown in FIG. 11, and consists of identical isosceles triangles each with a base of 64.9 mm and a height (h) of 30.4 mm. This cylindrical core PCCP1 weighs 406 g, which is almost equal to the weight, 407 g, of the conventional cylindrical core "a".

Suppose that the circumferences of those cores are compressed and displacement of 20 mm is attained in each core. In that case, the normal cylindrical core "a" requires a load of 0.66 kgf, while the core PCCP1 with the PCCP structure requires that of 3.08 kgf.

Derived from dividing each of these load values by the displacement value and further by the weight of the corresponding core is compressive strength of the core per unit weight. As seen in Table 1, the compressive strength of the normal cylindrical core "a" is $8.1\times10^{-5}$ kgf/(mm.g), whereas that of PCCP1 is $37.5\times10^{-5}$ kgf/(mm.g). Thus, it can be said that the cylindrical core PCCP1 made with the PCCP structure considerably increases the compressive strength, by about 4.6 times in this case, without increasing the weight of the core.

If a cylindrical core with a conventional smooth surface is formed so as to have rigidity identical to that of the above cylindrical core PCCP1 having the PCCP structure (both cores being made of identical polypropylene sheets), the thickness of this smooth cylindrical core "b" can be calculated as follows. When a cross-section secondary moment of the cylindrical core with the PCCP structure is expressed as Ip and that of the smooth cylindrical core as Ia, the following equation can be given from Table 1:

$$Ip=4.6\times Ia \quad (1)$$

The cross-section secondary moment Ia of the smooth cylindrical core with a height of 2H and a thickness of Ta is calculated as follows:

$$Ia=(h\times Ta^3)\div 6 \quad (2)$$

From the above equations (1) and (2), the cross-section secondary moment Ip of the cylindrical core with the PCCP structure is expressed as follows:

$$Ip=(4.6\times h\times Ta^3)\div 6 \quad (3)$$

Since the cross-section secondary moment Ib of a smooth cylindrical core with a height of 2h and a thickness of Tb is calculated as:

$$Ib=(h\times Ta^3)\div 6, \quad (4)$$

if this moment Ib of the smooth cylindrical core is identical to the moment Ip of the cylindrical core having the PCCP structure, i.e., $$Ib=Ip, \quad (5)$$

we have the following equations from the equations (3), (4) and (5):

$$(h\times Ta^3)\div 6=(4.6\times h\times Ta^3)\div 6$$

$$Ta^3=4.6Ta^3$$

Here, if Ta=0.9 mm, we have $$Tb=1.50 \text{ mm}.$$

As a result, the smooth cylindrical core "b" having the same rigidity as the PCCP1 has a thickness of 1.50 mm, and it weighs 678 g. The 0.9 mm thick PCCP1, on the other hand, weighs 406 g. Their difference in weight is 272 g, which brings about 40% weight reduction.

Another cylindrical core PCCP2 having the PCCP structure consists of identical isosceles triangles each having a base of 80.4 mm and a height (h) of 31.0 mm. It can be seen from Table 1 that this PCCP2 has compressive strength per unit weight about 8.7 times that of the normal smooth cylindrical core "a". Now, a cylindrical core "c" having a smooth surface is made to have the same compressive strength as that of the PCCP2. According to calculations similar to those above, a polypropylene sheet used to make the core "c" has a thickness of 1.85 mm, and the core "c" weighs 836 g, as shown in Table 1. The PCCP2 with the PCCP structure, on the other hand, weighs only 411 g. Their difference in weight is 425 g, and thus, 51% weight reduction can be achieved.

As apparent from the above examples, in the case of a cylindrical core with the PCCP structure, the rigidity towards the central axis of the cylinder varies as the shape of isosceles triangles constituting the PCCP structure changes. In other words, with the cylindrical cores having the same bottom diameters, those having triangles with shorter bases 81 and greater height h, i.e., the cylindrical cores having smoother surfaces exhibit greater resistance against compression in the longitudinal direction of the caddie bag. In contrast, the cylindrical cores having triangles with longer bases 81 and smaller height h are more resistant to compression from the side surfaces.

As the core of the caddie bag, it is desirable that the cylindrical form have a maximum resistance against compression from the side surfaces. It also needs to have sufficient compressive strength to prevent buckling when it is weighted with a person lengthwise. Therefore, the shape of the isosceles triangles constituting the PCCP structure should be determined by finding a good balance between these two constraints, which in turn will allow a certain degree of freedom in designing.

Hereinafter, specific embodiments of the present invention will be described.

Figure 1:
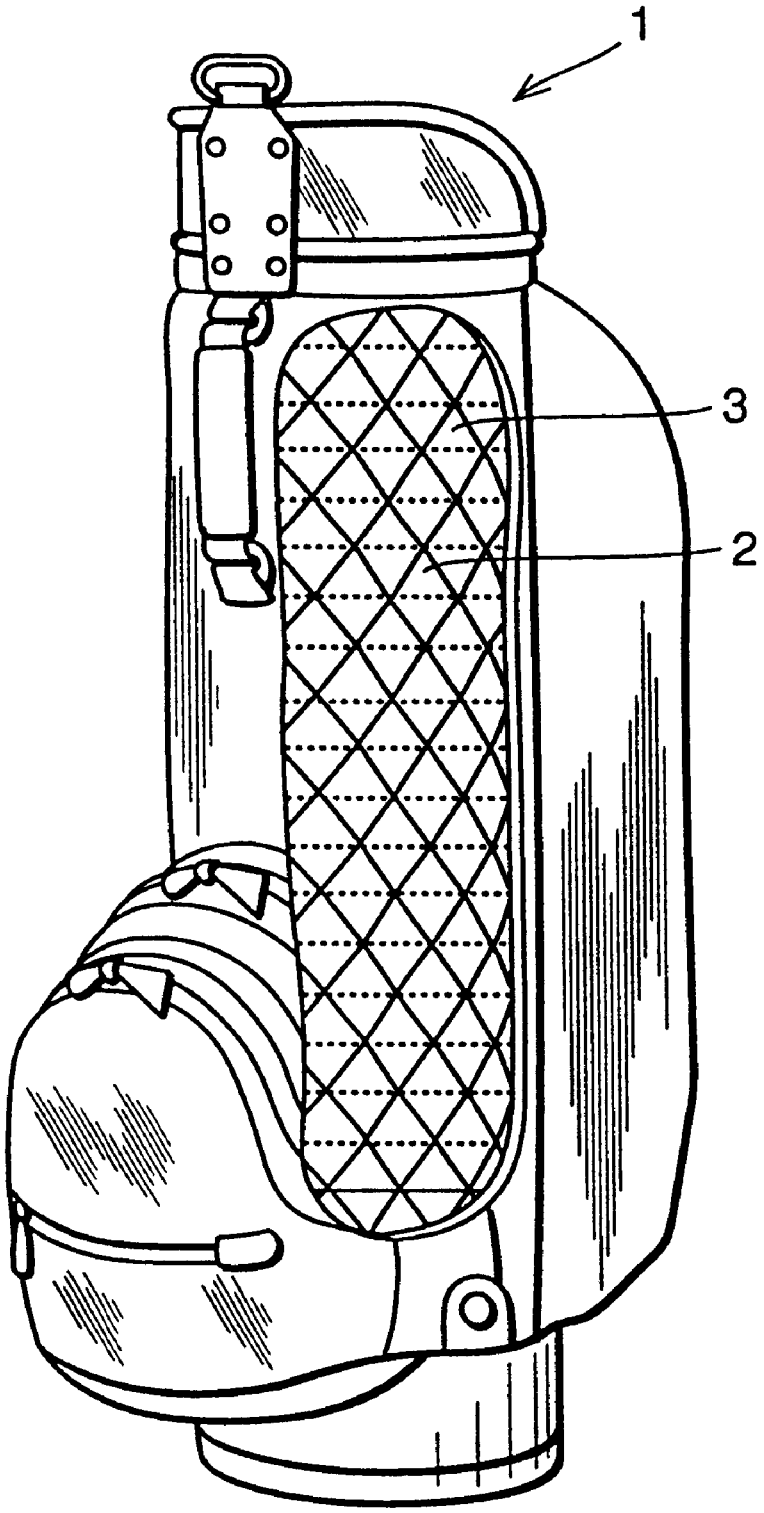
FIG. 1 is a partially cut-away view of a caddie bag using a core having a PCCP structure according to an embodiment of the present invention.

FIG. 1 is a partially cut-away view of a caddie bag 1 having a normal diameter of 8.5 inches (a bottom diameter of 210 mm), using a core having a PCCP structure 2. For caddie bag 1 shown in FIG. 1, a sheet of synthetic resin of 720 mm (height)×690 mm (circumference) is prepared, which is fabricated with PCCP structure 2. This sheet of synthetic resin with PCCP structure 2 is sewn into a cylindrical form to be used as a core 3 of the caddie bag. Next, this core structure is inserted into surface leather with a back bag and a pocket stitched thereto. The surface leather and the core structure now in the cylindrical form are provided with a collar portion and a bottom portion stitched thereto, whereby the caddie bag is finished.

Figure 2:
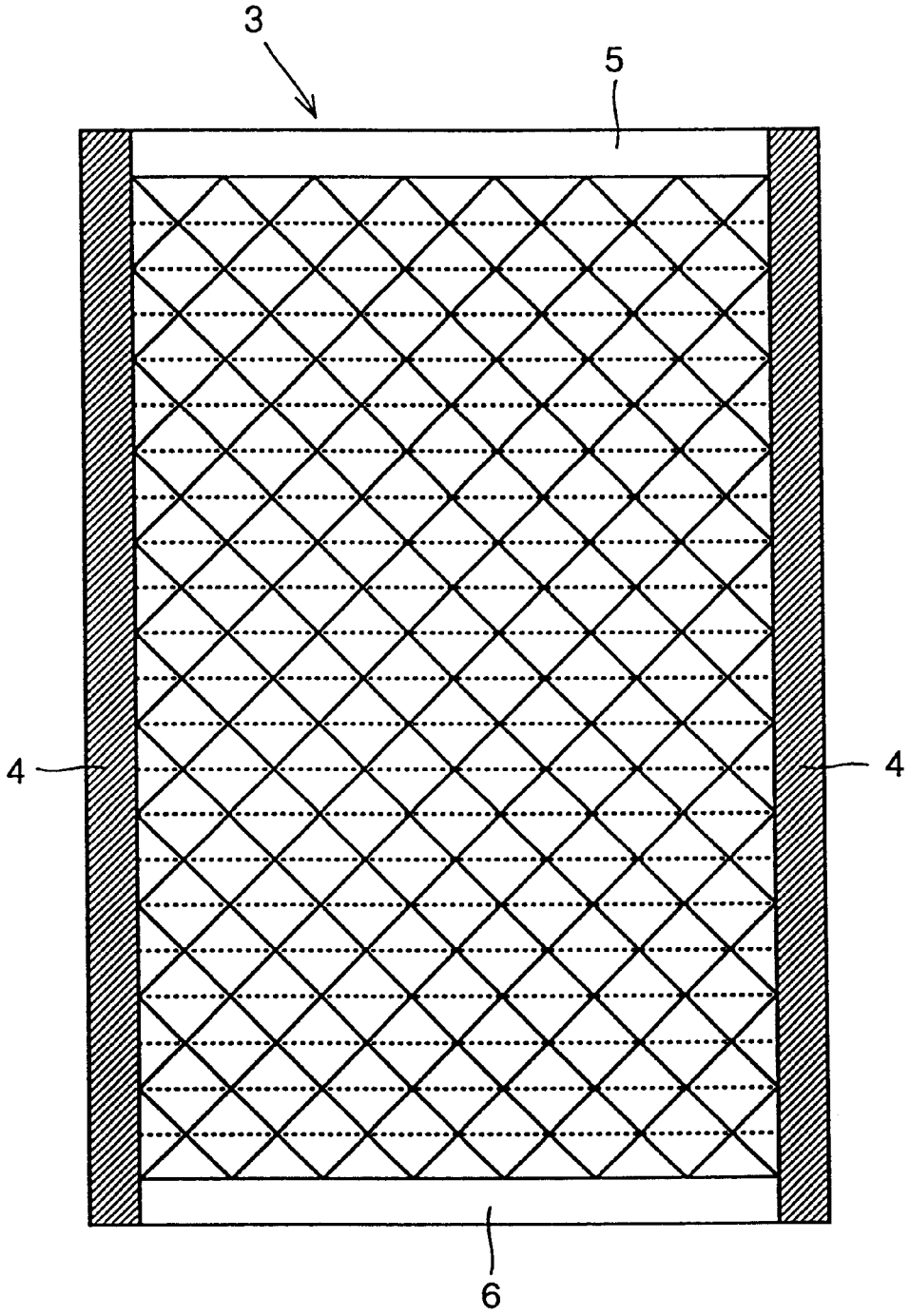
FIG. 2 is a spread-out view of the core used for the caddie bag shown in FIG. 1.

In FIG. 2, the synthetic resin sheet with PCCP structure 2 has an overlapping portion 4 where no PCCP structure 2 is provided. Having a 25 mm to 100 mm wide smooth surface as overlapping portion 4 not only allows easier machine-stitching or riveting, but also makes possible adjustment of the portion to be overlapped to correspond to caddie bags in different sizes. Moreover, if weight reduction is required, unnecessary overlapping portion 4 can be cut out. If additional strength is required, overlapping portion 4 can be left longer than what is needed.

In FIG. 2, seam allowances for collar portion 5 and bottom portion 6 also have smooth surfaces without PCCP structure 2, the purpose of which is also to ease stitching.

Figure 3A:
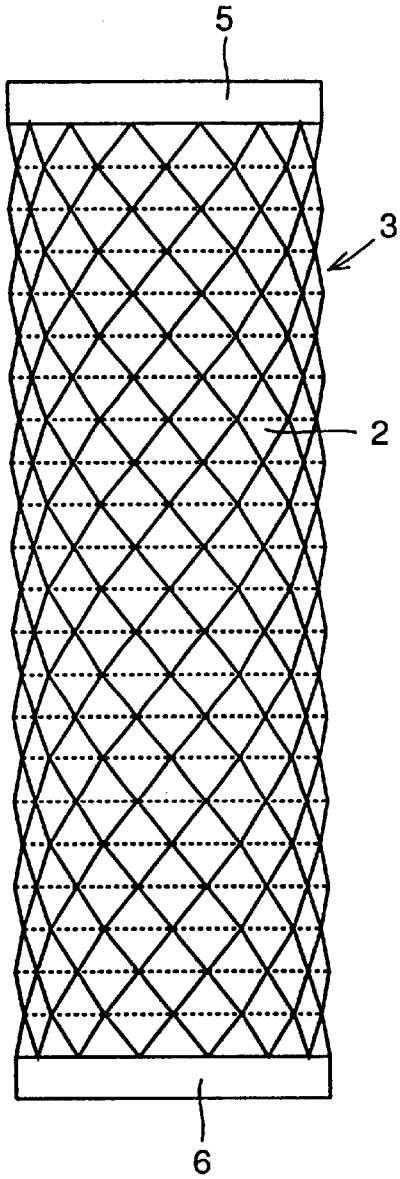
FIG. 3A is a front view of the core shown in FIG. 2 that is shaped into a cylindrical form.

FIG. 3A is a front view of the above-described synthetic resin sheet that is rolled into a cylindrical form to be used as core 3 of a caddie bag. Other than this kind of embodiment, it is also possible to implement an embodiment having overlapping portion 4, collar portion 5 and bottom portion 6 all left with PCCP structure 2.

Figure 3B:
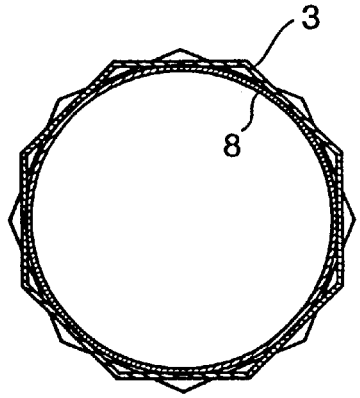
FIGS. 3B to 3D are top plan views of the core.

As shown in FIG. 3B, it is also possible to constitute a double-layered structure by superposing a smooth second core 8 without the PCCP structure on the inner surface of core 3 having the PCCP structure. Such a double-layered structure can enjoy inconsistent characteristics that, on one hand, the core 3 with the PCCP structure exhibits greater compressive strength against compression from the side surface, and on the other hand, the smooth second core 8 exhibits greater compressive strength lengthwise. In addition, even if the outer core 3 with the PCCP structure is pushed in, such deformation is expected to be restored because of the bounce of the second, smooth core 8 on the inner side. The double-layered structure is suited for a caddie bag, since it minimizes damages against golf clubs when they are being taken out of the bag. Otherwise, the contact of the clubs with the exposed hard core 3 would cause considerable damages to the clubs.

Figure 3C:
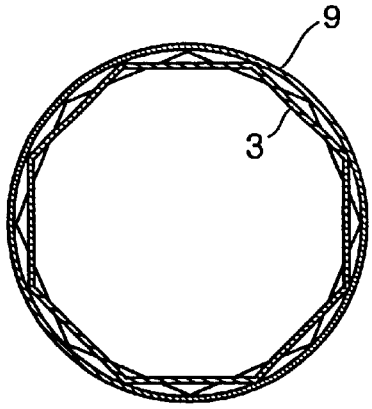

Furthermore, it is also possible to constitute a double-layered structure by superposing a second smooth core 9 without the PCCP structure on the outer surface of the core 3 having the PCCP structure, as shown in FIG. 3C. This type of double-layered structure improves rigidity against compression in both horizontal and vertical directions, as described above. In addition, it prevents the uneven shape of the PCCP structure 2 from being visible on the surface of the caddie bag as a finished product.

Figure 3D:
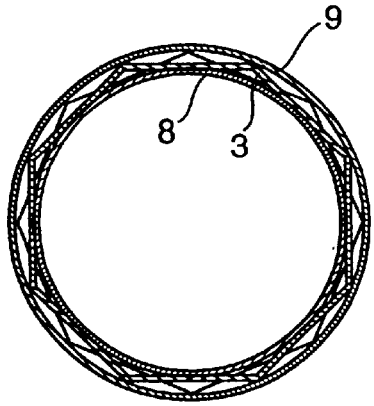

Still further, it is possible to constitute a triple-layered structure by superposing on the inner and outer surfaces of core 3 having the PCCP structure, a smooth core 8 without the PCCP structure and an identical core 9 without the PCCP structure, respectively, as shown in FIG. 3D. The PCCP structure may be provided entirely or partially on the surface of any core of a caddie bag, depending on rigidity required for that caddie bag. A core partially provided with the PCCP structure may also be overlaid with a smooth core, on either its inner or outer surface to constitute a double-layered structure, or, on both its surfaces to constitute a triple-layered structure.

Figure 4:
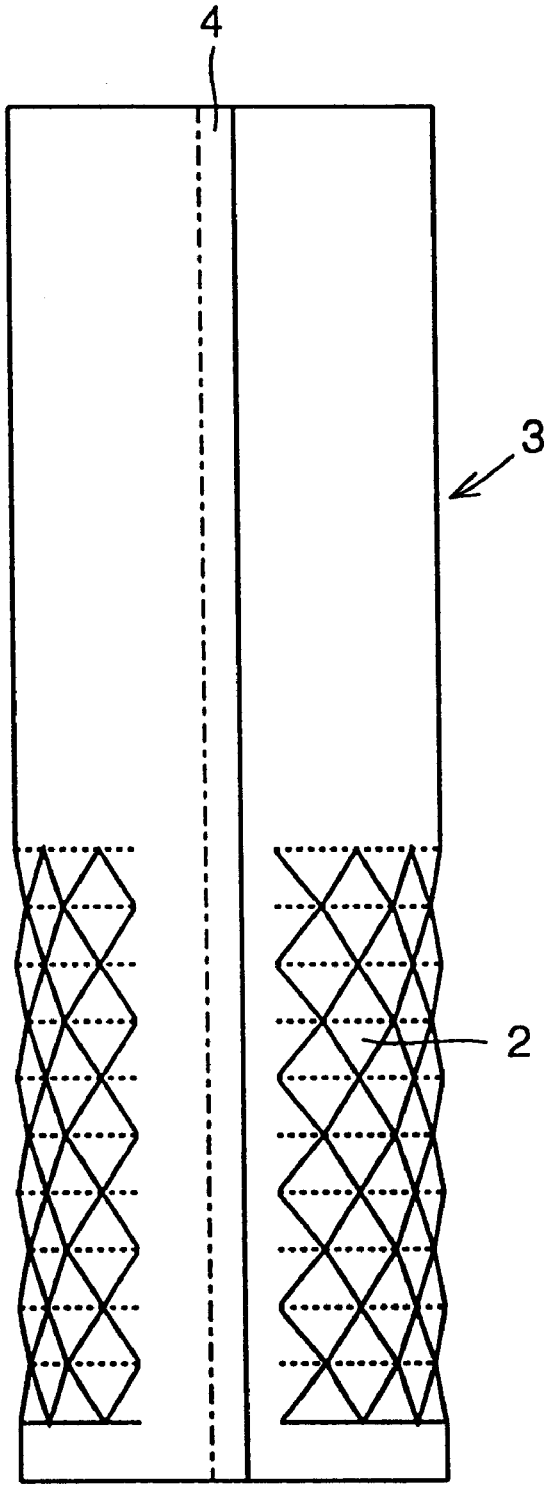
FIG. 4 is a rear view of the core for a caddie bag having the PCCP structure, according to another embodiment.

FIG. 4 is a back view of a cylinder made of core 3 provided with the PCCP structure 2 in approximately half of the structure starting from the bottom. In this embodiment, overlapping portions 4 are made smooth, without the PCCP structure 2. This PCCP structure 2 provided only in approximately half of the structure at the bottom is intended to increase the rigidity in the corresponding portion of the caddie bag, since pockets will be attached to the portion, and thus, especially serious deformation and breaks are expected there.

Figure 5:
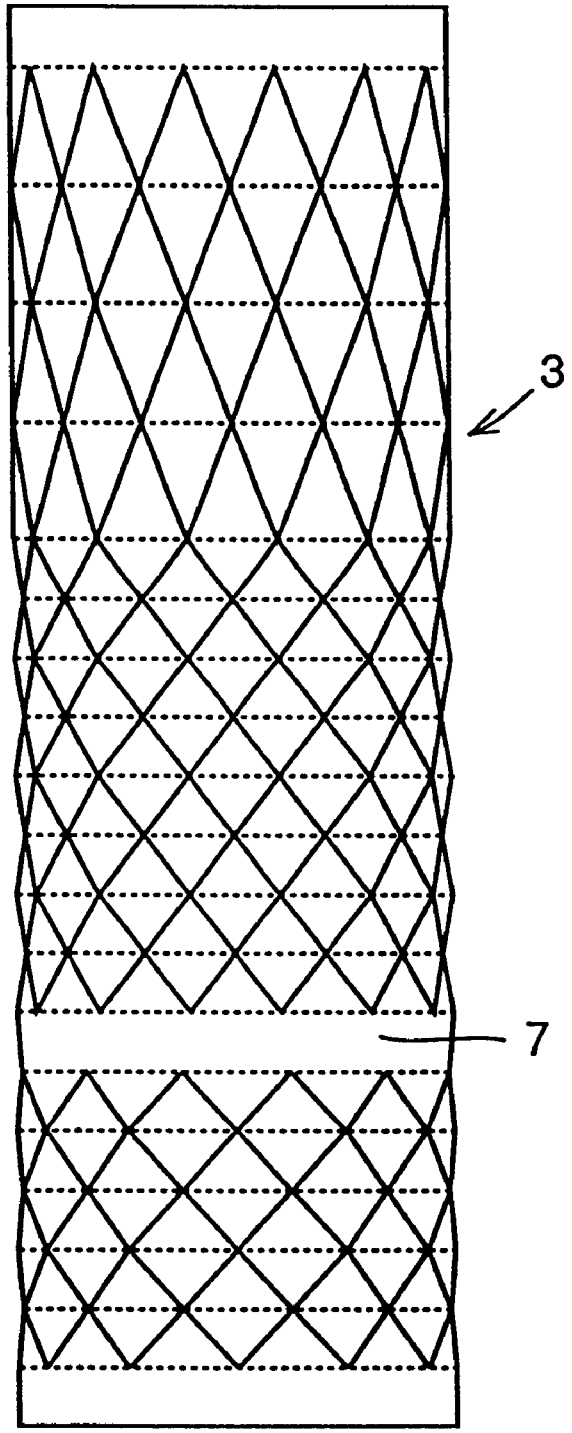
FIG. 5 is a front view of the core for a caddie bag having the PCCP structure, according to yet another embodiment.

FIG. 5 shows an example of core 3 having PCCP structure 2 with isosceles triangles of different shapes in different portions according to structural requirements. In the embodiment shown in FIG. 5, core 3 has triangles with greater heights in approximately one-third of the core at the top, so as to increase compressive strength lengthwise. Below this one-third portion down to a smooth portion 7, it has a normal PCCP structure, and below the smooth portion 7 to the bottom, the triangles are made to have longer bases to obtain greater resistance to compression from the side surface. Thus, by changing the lengths of bases of the isosceles triangles constituting the PCCP structure 2, rigidity of caddie bag core 3 can be designed more meticulously, section by section.

Figure 6:
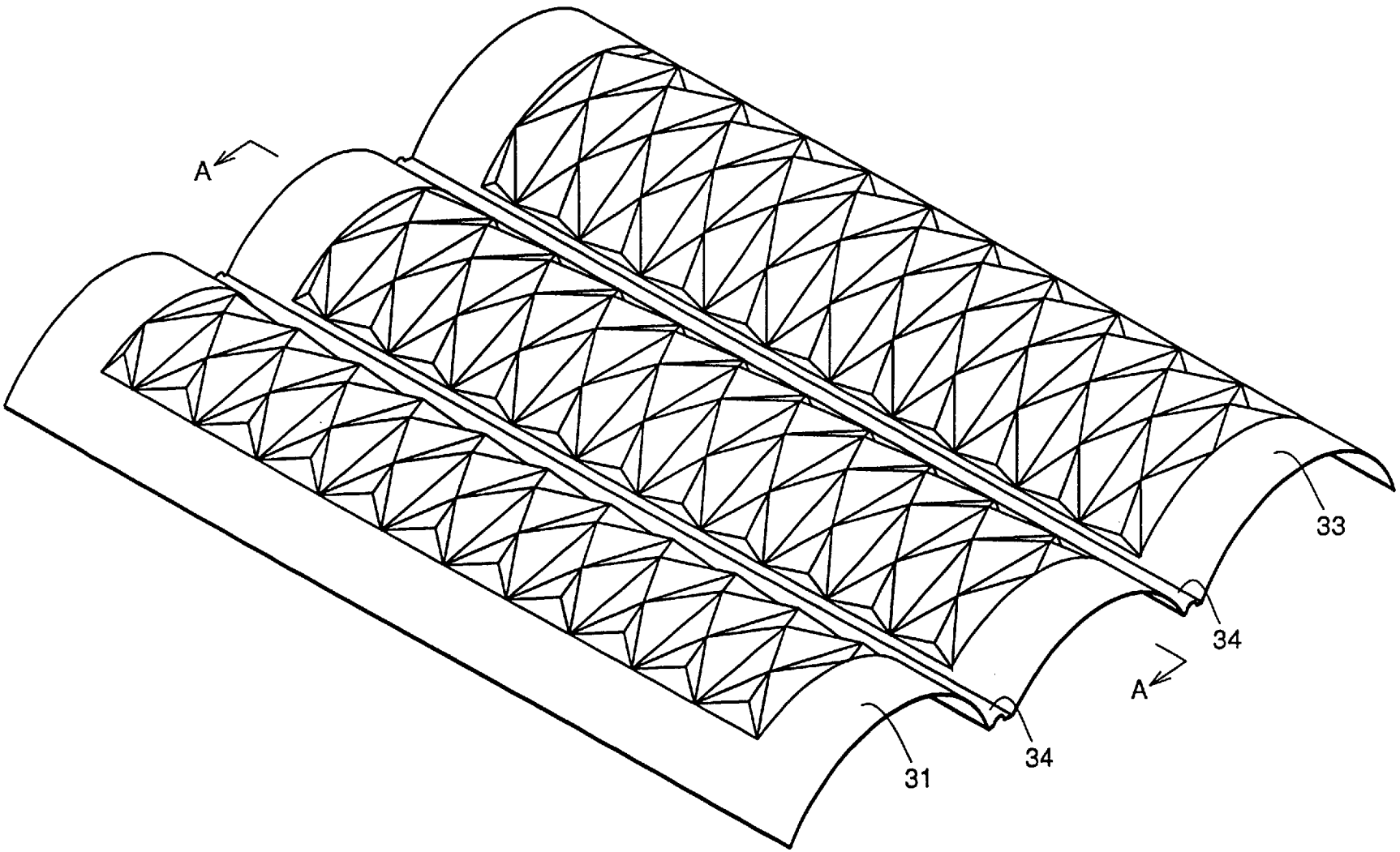
FIG. 6 is a spread-out view illustrating how three arc portions having the PCCP structure are connected by a hinge portion.
Figure 7:
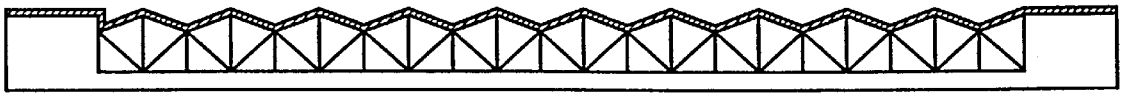
FIG. 7 is a cross sectional view taken along the line A—A of FIG. 6.

FIG. 6 shows a developed view of three arc portions with the PCCP structure connected to one another by a hinge portion. FIG. 7 is a cross sectional view taken along the line A—A in FIG. 6.

In the embodiment shown in FIG. 6, caddie bag core 3 is divided into three portions, i.e., arc portions 31, 32 and 33, which are connected to one another by a hinge portion 34. The PCCP structure has an inherent problem that, when a core having the PCCP structure is formed into a cylindrical form, the lengthwise dimension of the cylindrical form varies as its radius of curvature changes. Accordingly, this embodiment includes hinge portion 34 and enables only this hinge portion 34 to bend, while portions 31, 32 and 33 with the PCCP structure are curved in advance. In this manner, the radius of curvature of arc portions 31, 32 and 33 are prevented from changing, so that distortion between the arc portions and the smooth, hinge portion 34 is eliminated. This solves the problem with lengthwise varying dimension.

Provision of hinge portion 34 can further increase rigidity of the caddie bag lengthwise, since hinge portion 34 serves as a rib. Though an example with three arc portions 31–33 has been described, it should be understood that the core may be divided into any number of sections, e.g., from 2 to 5.

Figure 10:
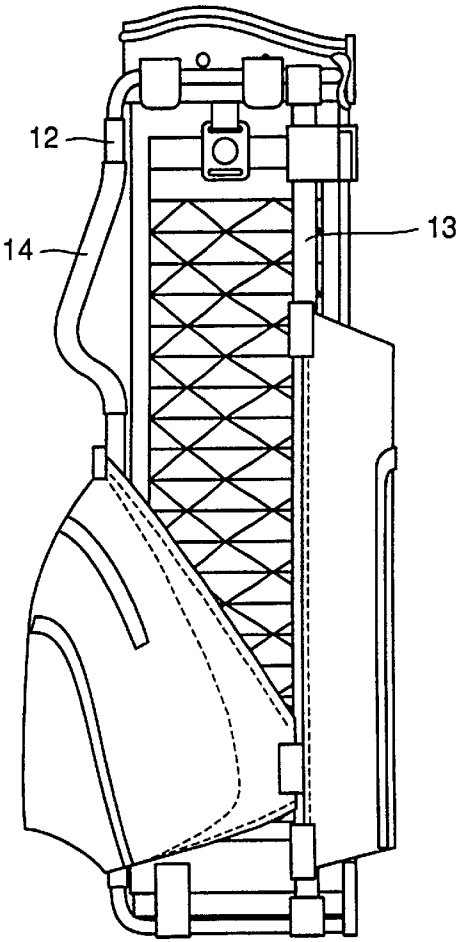
FIG. 10 is a side view of the caddie bag shown in FIG. 9 with a pocket attached thereto.
Figure 9:
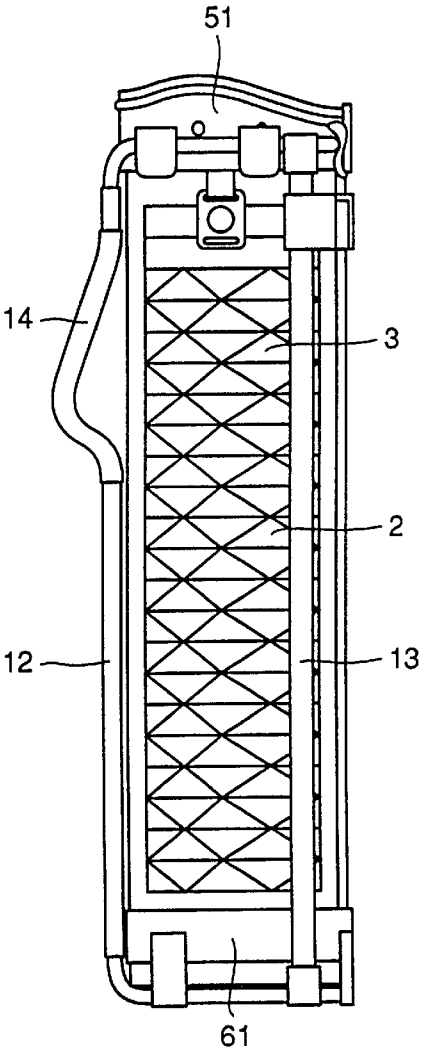
FIG. 9 is a side view of the caddie bag shown in FIG. 8 with a pipe frame connected thereto.
Figure 8:
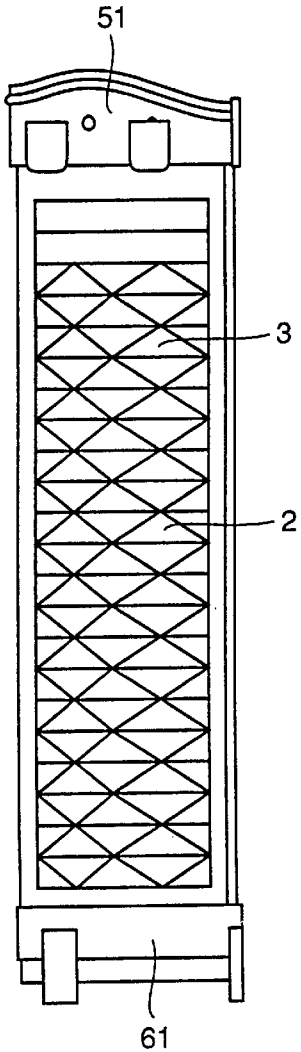
FIG. 8 is a side view of a caddie bag with a collar and a bottom member attached to the core structure.

FIG. 8 is a side view of a caddie bag with a collar attached to the caddie bag core. FIG. 9 is a side view of the caddie bag shown in FIG. 8 with a pipe frame connected thereto. FIG. 10 is a side view of the caddie bag of FIG. 9 with pockets attached thereto.

As shown in FIG. 8, a collar 51 and a bottom 61 are attached to core 3 with the PCCP structure 2, at the top and the bottom, respectively. This structure can readily be used as caddie bag 1, since such PCCP structure 2 guarantees large resistance to compression from the side surfaces.

As shown in FIG. 9, a pipe frame 12 is connected to caddie bag 1, to protect caddie bag 1 from compression lengthwise. If pipe frame 12 is detachable from the body of caddie bag 1 at a connecting portion employing a hook, zipper, release buckle, or adjustment buckle, it becomes possible to detach pipe frame 12 and to load a cart only with the body of caddie bag 1 when playing on a course.

A portion of pipe frame 12 may be bent to provide a handle 14. Using this handle 14 made of the highly rigid pipe frame, it is possible to carry caddie bag 1 more stably.

In addition to pipe frame 12, an auxiliary frame 13 may be provided. This can further protect caddie bag 1 from compression in both horizontal and vertical directions. Though iron, aluminum, FRP, acrylonitrile butadiene styrene (ABS), polyvinyl chloride, polycarbonate, and polyamide may be used as a material of pipe frame 12, aluminum is preferable for its strength, gravity, workability, and thermostability. Pipe frame 12 is made of a plurality of parts, which are assembled by welding, riveting, or using joint parts.

Furthermore, as shown in FIG. 10, pockets for storing golf accessories, such as golf balls, gloves and rain wares, may be attached to pipe frame 12 or auxiliary frame 13, or, although not shown, mounted on the body of the caddie bag.

Moreover, in addition to changing shapes of isosceles triangles constituting the PCCP structure corresponding to design goals, as explained above, it is also possible to constitute the PCCP structure with simple triangles or trapezoids, instead of the isosceles triangles.

For a synthetic resin sheet as the material of caddie bag core 3, polypropylene, polyethylene, ABS, polyvinyl chloride, polycarbonate, polyamide, and polyethylene terefthalate may be used. Among them, polypropylene is most preferable due to its price, fabricating process, gravity, modulus of elasticity, and thermostability.

As a method of providing the synthetic resin sheet with the PCCP structure, vacuum molding, molding under compressed air, and blow molding are available. Vacuum molding is preferable when taking into consideration ease in transportation and storage after molding, investment for a mold, applicability to different sizes of caddie bags, use of expanded synthetic resin sheet, and moldability in multi-layers by overlaying layers of different materials on inner and outer surfaces of the core. For molding in multi-layers by overlaying layers of different materials on only one side of the core, injection press molding is suitable because of its simplicity of the overlaying process.

Blow molding is suitable for assuring a uniform cylindrical form without a seam, ease in adjustment of the thickness of the core, and reduction in number of the process steps after formation of the PCCP structure.

INDUSTRIAL APPLICABILITY

As explained above, according to the present invention, a core structure for a caddie bag with the PCCP structure exhibits higher rigidity towards the central axis of the cylinder compared with a core structure having a smooth surface of the same thickness. Therefore, employing the PCCP structure, it is possible to design a caddie bag with improved rigidity towards the central axis of the cylinder while minimizing the increase in the weight. It is also possible to have a lightweight core structure, and hence, a lightweight caddie bag. Cost reduction can be achieved because there is no need to use an expensive high-strength material or a reinforcement.

What is claimed is:

1. A core of a caddie bag, formed by dividing a resin sheet in a circumferential direction into a plurality of sheets, connecting neighboring said divided sheets by hinge portions, applying by molding a PCCP (Pseudo-Cylindrical Concave Polyhedral) structure to each said divided sheet and causing said divided sheet to have an arc-formed cross section in a radial direction, and folding said hinge portions and seaming end portions in the circumferential direction of said resin sheet to obtain a cylindrical shape.

2. A caddie bag, comprising:

a cylindrical core formed by dividing a resin sheet in a circumferential direction into a plurality of sheets, connecting neighboring said divided sheets by hinge portions, applying a PCCP (Pseudo-Cylindrical Concave Polyhedral) structure to each said divided sheet by molding and causing said divided sheet to have an arc-formed cross section in a radial direction, and folding said hinge portions and seaming end portions in the circumferential direction of said resin sheet to obtain a cylindrical shape;

a collar attached to an opening on one end of said core; and a bottom member attached to another end of said core.

3. A method of manufacturing a caddie bag, comprising the steps of:

forming a cylindrical core by dividing a resin sheet in a circumferential direction into a plurality of sheets, connecting neighboring said divided sheets by hinge portions, applying by molding a PCCP (Pseudo-Cylindrical Concave Polyhedral) structure to each said divided sheet and causing said divided sheet to have an arc-formed cross section in a radial direction, and folding said hinge portions and seaming end portions in the circumferential direction of said resin sheet to obtain a cylindrical shape;

attaching a collar to an opening of one end of said core; and attaching a bottom member to another end of said core.

4. The manufacturing method of a caddie bag according to claim 3, wherein said step of forming a core includes the step of forming a core having the PCCP structure at least at a portion of said divided sheet.

5. The manufacturing method of a caddie bag according to claim 3, wherein the end portions in the circumferential direction of said resin sheet are smoothly finished without the PCCP structure, and seamed to form said cylindrical core.

6. The manufacturing method of a caddie bag according to claim 3, wherein upper and lower ends of said resin sheet are smoothly finished without the PCCP structure, to which said collar and said bottom member are attached, respectively.

7. The manufacturing method of a caddie bag according to claim 3, wherein said PCCP structure is formed of either ones of isosceles triangles and trapezoids, and said core includes a structure varied in either one of height and base of either ones of said isosceles triangles and trapezoids.

8. The manufacturing method of a caddie bag according to claim 3, further comprising the step of superimposing a reinforcing core without said PCCP structure on at least one of an outer surface and an inner surface of said cylindrical core.

* * * * *

UNITED STATES PATENT AND TRADEMARK OFFICE

CERTIFICATE OF CORRECTION

PATENT NO. : 6,431,355 B1
DATED : August 13, 2002
INVENTOR(S) : Koryo Miura et al.

It is certified that error appears in the above-identified patent and that said Letters Patent is hereby corrected as shown below:

Title page,
Item [54], change the Title from "CORE MATERIAL FOR CADDLE BAG AND CADDIE BAG USING THE CORE MATERIAL" to -- CORE FOR CADDIE BAG AND CADDIE BAG USING SAME CORE --

Signed and Sealed this

Eleventh Day of March, 2003

JAMES E. ROGAN
*Director of the United States Patent and Trademark Office*